US010968784B2

(12) United States Patent
Yan et al.

(10) Patent No.: US 10,968,784 B2
(45) Date of Patent: Apr. 6, 2021

(54) FLEXIBLE COAL-FIRED POWER GENERATION SYSTEM AND OPERATION METHOD THEREOF

(71) Applicant: XI'AN JIAOTONG UNIVERSITY, Shaanxi (CN)

(72) Inventors: Hui Yan, Shaanxi (CN); Ming Liu, Shaanxi (CN); Daotong Chong, Shaanxi (CN); Jinshi Wang, Shaanxi (CN); Weixiong Chen, Shaanxi (CN); Junjie Yan, Shaanxi (CN)

(73) Assignee: XI'AN JIAOTONG UNIVERSITY, Shaanxi (CN)

( * ) Notice: Subject to any disclaimer, the term of this patent is extended or adjusted under 35 U.S.C. 154(b) by 0 days.

(21) Appl. No.: 17/043,675

(22) PCT Filed: Jun. 22, 2019

(86) PCT No.: PCT/CN2019/092427
§ 371 (c)(1),
(2) Date: Sep. 30, 2020

(87) PCT Pub. No.: WO2020/181675
PCT Pub. Date: Sep. 17, 2020

(65) Prior Publication Data

US 2021/0033004 A1 Feb. 4, 2021

(30) Foreign Application Priority Data

Mar. 11, 2019 (CN) ..... 201910181229.2

(51) Int. Cl.
*F01K 11/02* (2006.01)
*F01K 17/02* (2006.01)
(Continued)

(52) U.S. Cl.
CPC ..... *F01K 11/02* (2013.01); *F01D 15/10* (2013.01); *F01K 7/22* (2013.01); *F01K 7/36* (2013.01);
(Continued)

(58) Field of Classification Search
CPC ... F01K 11/02; F01K 7/22; F01K 7/40; F01K 7/36; F01K 7/38; F01K 13/02; F01K 17/02; F01D 15/10
(Continued)

(56) References Cited

U.S. PATENT DOCUMENTS 6,052,996 A * 4/2000 Clark ..... F01K 23/04 60/650
6,134,891 A * 10/2000 Zaviska ..... F01K 13/02 60/648
(Continued)

FOREIGN PATENT DOCUMENTS

CN 106885232 A 6/2017
CN 207122890 U 3/2018
(Continued)

*Primary Examiner* — Hoang M Nguyen

(57) ABSTRACT

A flexible coal-fired power generation system includes a thermal system for coal-fired power generating unit and a high-temperature heat storage system connected in parallel, wherein: the heat storage system includes a heat storage medium pump (17), a cold heat storage medium tank (18), a hot heat storage medium tank (20), multiple valves, and a heat storage medium and feedwater heat exchanger (21). A heat storage medium heater (16) locates in the boiler (1) and is connected with both the cold heat storage medium tank (18) and the hot heat storage medium tank (20). Through the heat storage medium pump (17), the flow of heat storage medium that enters the heat storage medium heater (16) is adjusted to reduce the output of the steam turbine when the boiler (1) is stably burning.

4 Claims, 1 Drawing Sheet

(51) Int. Cl.

| | |
|---|---|
| ***F01D 15/10*** | (2006.01) |
| ***F01K 13/02*** | (2006.01) |
| ***F01K 7/38*** | (2006.01) |
| ***F01K 7/22*** | (2006.01) |
| ***F01K 7/40*** | (2006.01) |
| ***F01K 7/36*** | (2006.01) |

(52) U.S. Cl.
CPC ..... *F01K 7/38* (2013.01); *F01K 7/40* (2013.01); *F01K 13/02* (2013.01); *F01K 17/02* (2013.01)

(58) Field of Classification Search
USPC ..... 60/653, 654, 677–680
See application file for complete search history.

(56) References Cited

U.S. PATENT DOCUMENTS

| | | | | |
|---|---|---|---|---|
| 8,820,078 | B1 * | 9/2014 | Duffy | F22B 1/00 60/646 |
| 2009/0125152 | A1 * | 5/2009 | Skowronski | F01K 7/40 700/281 |

FOREIGN PATENT DOCUMENTS

| | | | |
|---|---|---|---|
| CN | 109139151 | A | 1/2019 |
| CN | 109854313 | A | 6/2019 |
| EP | 2942492 | A1 | 11/2015 |

* cited by examiner

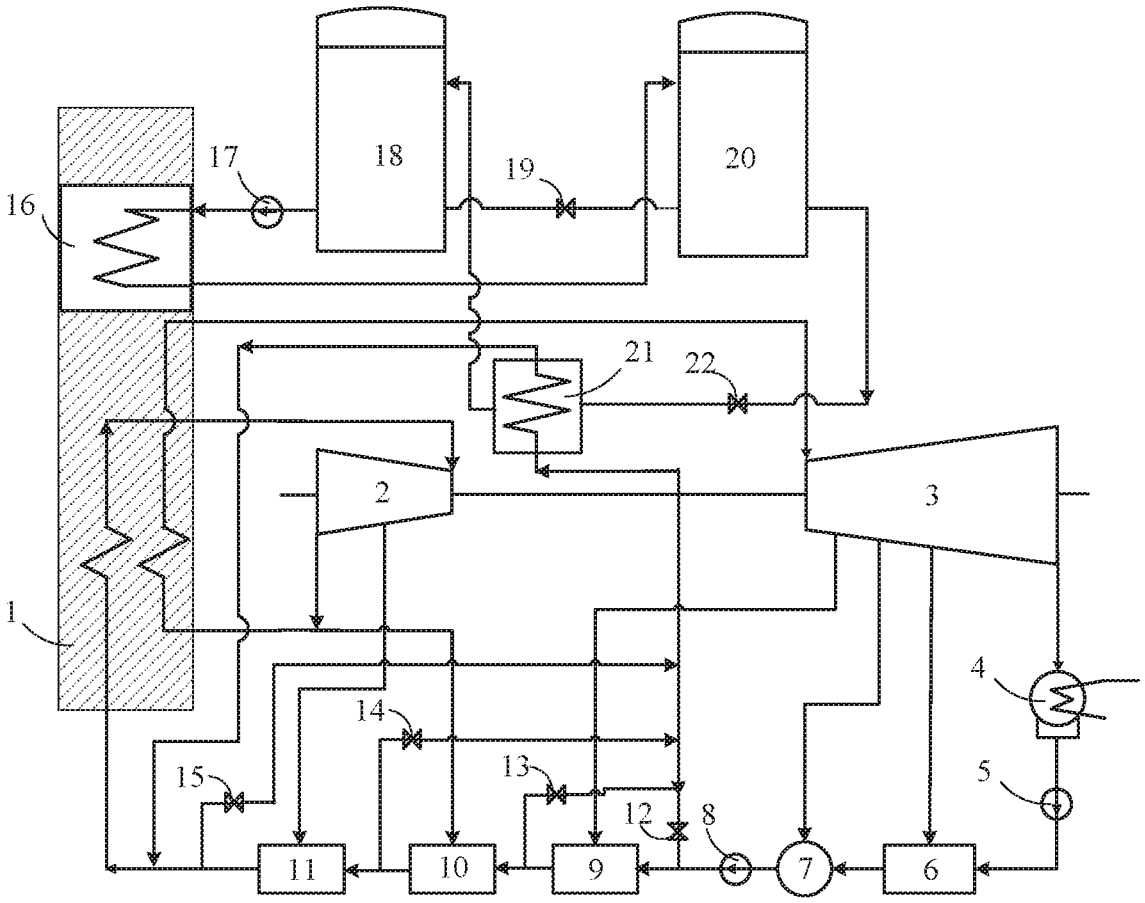
18
20
17
19
16
21
22
2
3
1
4
14
15
13
5
12
8
11
10
9
7
6

FLEXIBLE COAL-FIRED POWER GENERATION SYSTEM AND OPERATION METHOD THEREOF

CROSS REFERENCE OF RELATED APPLICATION

This is a U.S. National Stage under 35 U.S.C 371 of the International Application PCT/CN2019/092427, filed Jun. 22, 2019, which claims priority under 35 U.S.C. 119(a-d) to CN 201910181229.2, filed Mar. 11, 2019.

BACKGROUND OF THE PRESENT INVENTION

Field of Invention

The present invention relates to the field of coal-fired power generation technology, and more particularly to a flexible coal-fired power generation system and an operation method thereof.

Description of Related Arts

In power system of China, the installed capacity of the coal-fired power generating unit accounts for a large proportion, and the flexible peak-shaving power supply thereof accounts for a small proportion. Therefore, the increased peak shaving task after the merging of large-scale wind power, solar power and other new energy is mainly undertaken by the coal-fired power generating unit, which puts forward a new requirement for the flexibility of the coal-fired power generating unit, requiring that the coal-fired power generating unit is able to be operated in load cycling processes with large amplitudes and high load cycling rates. The strong coupling between the boiler and the steam turbine of the existing thermal system limits the minimum output of the coal-fired power generating unit. At present, there is no reasonable solution for the coal-fired power generating unit to meet the requirements of the power grid for load cycling and low load operation performance. The problems need to be solved are as follows.

(1) When wide-load operation is required, the steam turbine has good load regulating ability, but the minimum load of the boiler is limited by the minimum steady state combustion load, so the boiler is the main factor that limits the flexibility of the coal-fired power generating unit. Therefore, it is necessary to realize the decoupling of the steam turbine and the boiler.

(2) When the grid requires quickly load cycling, the heat storage capacity inside the coal-fired power generation system is limited, so it is necessary to find a more efficient and potential heat storage system to cooperate with the traditional coal-fired power generation system.

SUMMARY OF THE PRESENT INVENTION

To solve the above technical problems in prior arts, an object of the present invention is to provide a flexible coal-fired power generation system and an operation method thereof. The system is added the active heat storage outside the coal-fired power generating unit and uses the heat storage medium for storing heat at high temperature, so as to realize the decoupling of the steam turbine and the boiler, so that the requirements of the power grid for load cycling performance of the coal-fired power generating unit are met.

To achieve the above object, the present invention adopts technical solutions as follows.

A flexible coal-fired power generation system comprises a thermal system for coal-fired power generating unit and a high-temperature heat storage system, wherein: the thermal system for coal-fired power generating unit comprises a boiler, a steam turbine high pressure cylinder, a steam turbine medium and low pressure cylinder, a condenser, a condensate pump, a low pressure heater, a deaerator, a feedwater pump, a first-stage high pressure heater, a second-stage high pressure heater, a third-stage high pressure heater, an inlet regulating valve for the first-stage high pressure heater, an inlet regulating valve for the second-stage high pressure heater, an inlet regulating valve for the third-stage high pressure heater and an outlet regulating valve for the third-stage high pressure heater; a heat storage medium heater is located in the boiler;

the high-temperature heat storage system comprises a heat storage medium pump, a cold heat storage medium tank, a hot heat storage medium tank, a connection valve for connecting the cold heat storage medium tank with the hot heat storage medium tank, a heat storage medium and feedwater heat exchanger and an outlet regulating valve for the hot heat storage medium tank, all of which are connected with each other in sequence;

an inlet of the heat storage medium heater is connected with a cold heat storage medium outlet of the cold heat storage medium tank through the heat storage medium pump; an outlet of the heat storage medium heater is connected with a hot heat storage medium inlet of the hot heat storage medium tank through a pipeline; a heat storage medium outlet of the heat storage medium and feedwater heat exchanger is connected with a cold heat storage medium inlet of the cold heat storage medium tank through a pipeline, and a heat storage medium inlet of the heat storage medium and feedwater heat exchanger is connected with a hot heat storage medium outlet of the hot heat storage medium tank through the outlet regulating valve for the hot heat storage medium tank; a feedwater inlet of the heat storage medium and feedwater heat exchanger is connected with a feedwater inlet of the first-stage high pressure heater through the inlet regulating valve for the first-stage high pressure heater, is connected with a feedwater inlet of the second-stage high pressure heater through the inlet regulating valve for the second-stage high pressure heater, is connected with a feedwater inlet of the third-stage high pressure heater through the inlet regulating valve for the third-stage high pressure heater, and is connected with a feedwater outlet of the third-stage high pressure heater through the outlet regulating valve for the third-stage high pressure heater; a feedwater outlet of the heat storage medium and feedwater heat exchanger is connected with the feedwater outlet of the third-stage high pressure heater; the cold heat storage medium tank is connected with the hot heat storage medium tank through the connection valve for connecting the cold heat storage medium tank with the hot heat storage medium tank; a superheated steam outlet of the boiler is connected with an inlet of the steam turbine high pressure cylinder; a feedwater inlet of the boiler is connected with the feedwater outlet of the third-stage high pressure heater; a steam outlet of the steam turbine high pressure cylinder is connected with a steam inlet of the steam turbine medium and low pressure cylinder through the boiler, and is connected with a superheated steam inlet of the second-stage high pressure heater through a pipeline; a first-stage steam extraction outlet of the steam turbine high pressure cylinder is connected with a steam inlet of the third-stage high pressure heater through a pipeline; a first-stage steam extraction outlet of the steam turbine medium and low pressure cylinder is connected with a steam inlet of the first-stage high pressure heater through a pipeline, and a second-stage steam extraction outlet of the steam turbine medium and low pressure cylinder is connected with a steam inlet of the deaerator through a pipeline, and a third-stage steam extraction outlet of the steam turbine medium and low pressure cylinder is connected with a steam inlet of the low pressure heater through a pipeline; a steam outlet of the steam turbine medium and low pressure cylinder is connected with a steam inlet of the condenser; a water outlet of the condenser is connected with a water inlet of the low pressure heater through the condensate pump; a water outlet of the low pressure heater is connected with a water inlet of the deaerator; a water outlet of the deaerator is connected with the feedwater inlet of the first-stage high pressure heater and the feedwater inlet of the heat storage medium and feedwater heat exchanger through the feedwater pump; a feedwater outlet of the first-stage high pressure heater is connected with the feedwater inlet of the second-stage high pressure heater through a pipeline; a feedwater outlet of the second-stage high pressure heater is connected with the feedwater inlet of the third-stage high pressure heater through a pipeline.

Preferably, a heat storage medium adopted by the high-temperature heat storage system is heat transfer oil.

Preferably, a flue gas temperature of the boiler where the heat storage medium heater is located is greater than 400° C.

Also, the present invention provides an operation method of the flexible coal-fired power generation system, which comprises steps of: when a load of a coal-fired power generating unit needs to be reduced, closing the inlet regulating valve for the first-stage high pressure heater, the inlet regulating valve for the second-stage high pressure heater, the inlet regulating valve for the third-stage high pressure heater and the outlet regulating valve for the third-stage high pressure heater, opening the connection valve for connecting the cold heat storage medium tank with the hot heat storage medium tank, staring the heat storage medium pump, adjusting a flow of cold heat storage medium that enters the heat storage medium heater and exchanges heat with high-temperature flue gas through the heat storage medium pump, heat storage medium after heat exchange entering the hot heat storage medium tank, and adjusting quantity of heat storage medium in the cold heat storage medium tank and quantity of heat storage medium in the hot heat storage medium tank to a balance through the connection valve for connecting the cold heat storage medium tank with the hot heat storage medium tank, wherein an adjustment goal is to reduce an output of a steam turbine when the boiler is stably burning;

when the load of the coal-fired power generating unit needs to be increased, stopping the heat storage medium pump, opening the outlet regulating valve for the hot heat storage medium tank, adjusting a flow of hot heat storage medium that enters the heat storage medium and feedwater heat exchanger through the outlet regulating valve, adjusting flow and temperature of feedwater that enters the heat storage medium and feedwater heat exchanger through switching on/off at least one of the inlet regulating valve for the first-stage high pressure heater, the inlet regulating valve for the second-stage high pressure heater, the inlet regulating valve for the third-stage high pressure heater and the outlet regulating valve for the third-stage high pressure heater, wherein adjustment goals are to increase the temperature of feedwater, and to make a flow change rate of main stream that enters the steam turbine high pressure cylinder through the boiler and a flow change rate of reheat stream that enters the steam turbine medium and low pressure cylinder through the boiler meet the requirement of an electric load change rate of the steam turbine, so that the flexible coal-fired power generation system is able to meet the requirement of fast load cycling rate.

Compared with the prior arts, the present invention has some advantages as follows.

(1) The present invention realizes the decoupling of the steam turbine and the boiler by increasing the heat storage outside the coal-fired power generating unit, and greatly improves the operation flexibility of the coal-fired power generation system.

(2) The present invention is able to adjust the flow of heat storage medium that flows into the heat storage medium heater. When the steam turbine requires to be operated at low load, the boiler combustion is able to be as unchanged as possible, and the heat storage medium is used to store the remaining high-grade energy outside the coal-fired power generating unit after meeting the load of the steam turbine, so as to improve the low-load operating capacity of the coal-fired power generation system and improve energy efficiency.

(3) According to the present invention, the flow and temperature of feedwater into the heat storage medium and feedwater heat exchanger is able to be controlled by adjusting at least one of the inlet regulating valve for the first-stage high pressure heater, the inlet regulating valve for the second-stage high pressure heater, the inlet regulating valve for the third-stage high pressure heater and the outlet regulating valve for the third-stage high pressure heater. By exchanging heat with the heat storage medium outside the coal-fired power generating unit, the temperature of the feedwater is increased, thereby improving the ability of the coal-fired power generating unit to quickly load cycle.

BRIEF DESCRIPTION OF THE DRAWINGS

The drawing is a structurally schematic view of a flexible coal-fired power generation system provided by the present invention.

DETAILED DESCRIPTION OF THE PREFERRED EMBODIMENT

The present invention is further explained with accompanying embodiments and drawings in detail as follows.

As shown in the drawing, a flexible coal-fired power generation system according to a preferred embodiment of the present invention is illustrated, which comprises a thermal system for coal-fired power generating unit and a high-temperature heat storage system, wherein:

the thermal system for coal-fired power generating unit comprises a boiler 1, a steam turbine high pressure cylinder 2, a steam turbine medium and low pressure cylinder 3, a condenser 4, a condensate pump 5, a low pressure heater 6, a deaerator 7, a feedwater pump 8, a first-stage high pressure heater 9, a second-stage high pressure heater 10, a third-stage high pressure heater 11, an inlet regulating valve 12 for the first-stage high pressure heater, an inlet regulating valve 13 for the second-stage high pressure heater, an inlet regulating valve 14 for the third-stage high pressure heater and an outlet regulating valve 15 for the third-stage high pressure heater; a heat storage medium heater 16 is located in the boiler 1;

the high-temperature heat storage system comprises a heat storage medium pump 17, a cold heat storage medium tank 18, a hot heat storage medium tank 20, a connection valve 19 for connecting the cold heat storage medium tank 18 with the hot heat storage medium tank 20, a heat storage medium and feedwater heat exchanger 21 and an outlet regulating valve 22 for the hot heat storage medium tank 20, all of which are connected with each other in sequence;

an inlet of the heat storage medium heater 16 is connected with a cold heat storage medium outlet of the cold heat storage medium tank 18 through the heat storage medium pump 17; an outlet of the heat storage medium heater 16 is connected with a hot heat storage medium inlet of the hot heat storage medium tank 20 through a pipeline; a heat storage medium outlet of the heat storage medium and feedwater heat exchanger 21 is connected with a cold heat storage medium inlet of the cold heat storage medium tank 18 through a pipeline, and a heat storage medium inlet of the heat storage medium and feedwater heat exchanger 21 is connected with a hot heat storage medium outlet of the hot heat storage medium tank 20 through the outlet regulating valve 22 for the hot heat storage medium tank; a feedwater inlet of the heat storage medium and feedwater heat exchanger 21 is connected with a feedwater inlet of the first-stage high pressure heater 9 through the inlet regulating valve 12 for the first-stage high pressure heater, is connected with a feedwater inlet of the second-stage high pressure heater 10 through the inlet regulating valve 13 for the second-stage high pressure heater, is connected with a feedwater inlet of the third-stage high pressure heater 11 through the inlet regulating valve 14 for the third-stage high pressure heater, and is connected with a feedwater outlet of the third-stage high pressure heater through the outlet regulating valve 15 for the third-stage high pressure heater; a feedwater outlet of the heat storage medium and feedwater heat exchanger 21 is connected with the feedwater outlet of the third-stage high pressure heater 11; the cold heat storage medium tank 18 is connected with the hot heat storage medium tank 20 through the connection valve 19 for connecting the cold heat storage medium tank with the hot heat storage medium tank; a superheated steam outlet of the boiler 1 is connected with an inlet of the steam turbine high pressure cylinder 2; a feedwater inlet of the boiler 1 is connected with the feedwater outlet of the third-stage high pressure heater 11; a steam outlet of the steam turbine high pressure cylinder 2 is connected with a steam inlet of the steam turbine medium and low pressure cylinder 3 through the boiler 1, and is connected with a superheated steam inlet of the second-stage high pressure heater 10 through a pipeline; a first-stage steam extraction outlet of the steam turbine high pressure cylinder 2 is connected with a steam inlet of the third-stage high pressure heater 11 through a pipeline; a first-stage steam extraction outlet of the steam turbine medium and low pressure cylinder 3 is connected with a steam inlet of the first-stage high pressure heater 9 through a pipeline, and a second-stage steam extraction outlet of the steam turbine medium and low pressure cylinder 3 is connected with a steam inlet of the deaerator 7 through a pipeline, and a third-stage steam extraction outlet of the steam turbine medium and low pressure cylinder 3 is connected with a steam inlet of the low pressure heater 6 through a pipeline; a steam outlet of the steam turbine medium and low pressure cylinder 3 is connected with a steam inlet of the condenser 4; a water outlet of the condenser 4 is connected with a water inlet of the low pressure heater 6 through the condensate pump 5; a water outlet of the low pressure heater 6 is connected with a water inlet of the deaerator 7; a water outlet of the deaerator 7 is connected with the feedwater inlet of the first-stage high pressure heater 9 and the feedwater inlet of the heat storage medium and feedwater heat exchanger 21 through the feedwater pump 8; a feedwater outlet of the first-stage high pressure heater 9 is connected with the feedwater inlet of the second-stage high pressure heater 10 through a pipeline; a feedwater outlet of the second-stage high pressure heater 10 is connected with the feedwater inlet of the third-stage high pressure heater 11 through a pipeline.

Preferably, a heat storage medium adopted by the high-temperature heat storage system is heat transfer oil.

Preferably, a flue gas temperature of the boiler 1 where the heat storage medium heater 16 is located is greater than 400° C.

An operation method of the flexible coal-fired power generation system provided by the present invention shown in the drawing comprises steps of: when a load of a coal-fired power generating unit needs to be reduced, closing the inlet regulating valve 12 for the first-stage high pressure heater, the inlet regulating valve 13 for the second-stage high pressure heater, the inlet regulating valve 14 for the third-stage high pressure heater and the outlet regulating valve 15 for the third-stage high pressure heater, opening the connection valve 19 for connecting the cold heat storage medium tank with the hot heat storage medium tank, staring the heat storage medium pump 17, adjusting a flow of cold heat storage medium that enters the heat storage medium heater 16 and exchanges heat with high-temperature flue gas through the heat storage medium pump 17, heat storage medium after heat exchange entering the hot heat storage medium tank 20, and adjusting quantity of heat storage medium in the cold heat storage medium tank and quantity of heat storage medium in the hot heat storage medium tank to a balance through the connection valve 19 for connecting the cold heat storage medium tank with the hot heat storage medium tank, wherein an adjustment goal is to reduce an output of a steam turbine when the boiler 1 is stably burning;

when the load of the coal-fired power generating unit needs to be increased, stopping the heat storage medium pump 17, opening the outlet regulating valve 22 for the hot heat storage medium tank, adjusting a flow of hot heat storage medium that enters the heat storage medium and feedwater heat exchanger 21 through the outlet regulating valve 22, adjusting flow and temperature of feedwater that enters the heat storage medium and feedwater heat exchanger 21 through switching on/off at least one of the inlet regulating valve 12 for the first-stage high pressure heater, the inlet regulating valve 13 for the second-stage high pressure heater, the inlet regulating valve 14 for the third-stage high pressure heater and the outlet regulating valve 15 for the third-stage high pressure heater, wherein adjustment goals are to increase the temperature of feedwater, and to make a flow change rate of main stream that enters the steam turbine high pressure cylinder 2 through the boiler 1 and a flow change rate of reheat stream that enters the steam turbine medium and low pressure cylinder 3 through the boiler 1 meet the requirement of an electric load change rate of the steam turbine, so that the flexible coal-fired power generation system is able to meet the requirement of fast load cycling rate.

According to the present invention, the high-temperature heat storage system is connected with the thermal system for coal-fired power generating unit in parallel, which breaks the strong coupling between the boiler and the steam turbine of the coal-fired power generating unit. When the steam turbine requires to be operated at low load, the flow of the heat storage medium that enters the heat storage medium heater 16 is adjusted, and the boiler combustion is able to be as unchanged as possible, and the heat storage medium is used to store the remaining high-grade energy after meeting the load of the steam turbine outside the coal-fired power generating unit, so as to achieve the decoupling of the steam turbine and the boiler, thereby improving the low-load operating capacity of the coal-fired power generation system, and simultaneously improving energy efficiency. Moreover, the flow and temperature of feedwater from the heat storage medium and feedwater heat exchanger 21 is able to be controlled through adjusting at least one of the inlet regulating valve 12 for the first-stage high pressure heater, the inlet regulating valve 13 for the second-stage high pressure heater, the inlet regulating valve 14 for the third-stage high pressure heater and the outlet regulating valve 15 for the third-stage high pressure heater. By exchanging heat with the heat storage medium outside the coal-fired power generating unit, the temperature of the feedwater is increased, thereby improving the ability to quickly cycle load of the coal-fired power generating unit. According to the present invention, the problems such as insufficient flexibility and low-load operation capacity are able to be solved when the coal-fired power generating unit participates in peak shaving.

What is claimed is:

1. A flexible coal-fired power generation system, which comprises a thermal system for coal-fired power generating unit and a high-temperature heat storage system, wherein:

the thermal system for coal-fired power generating unit comprises a boiler (1), a steam turbine high pressure cylinder (2), a steam turbine medium and low pressure cylinder (3), a condenser (4), a condensate pump (5), a low pressure heater (6), a deaerator (7), a feedwater pump (8), a first-stage high pressure heater (9), a second-stage high pressure heater (10), a third-stage high pressure heater (11), an inlet regulating valve (12) for the first-stage high pressure heater, an inlet regulating valve (13) for the second-stage high pressure heater, an inlet regulating valve (14) for the third-stage high pressure heater and an outlet regulating valve (15) for the third-stage high pressure heater; a heat storage medium heater (16) is located in the boiler (1);

the high-temperature heat storage system comprises a heat storage medium pump (17), a cold heat storage medium tank (18), a hot heat storage medium tank (20), a connection valve (19) for connecting the cold heat storage medium tank (18) with the hot heat storage medium tank (20), a heat storage medium and feedwater heat exchanger (21) and an outlet regulating valve (22) for the hot heat storage medium tank (20), all of which are connected with each other in sequence;

an inlet of the heat storage medium heater (16) is connected with a cold heat storage medium outlet of the cold heat storage medium tank (18) through the heat storage medium pump (17); an outlet of the heat storage medium heater (16) is connected with a hot heat storage medium inlet of the hot heat storage medium tank (20) through a pipeline; a heat storage medium outlet of the heat storage medium and feedwater heat exchanger (21) is connected with a cold heat storage medium inlet of the cold heat storage medium tank (18) through a pipeline, and a heat storage medium inlet of the heat storage medium and feedwater heat exchanger (21) is connected with a hot heat storage medium outlet of the hot heat storage medium tank (20) through the outlet regulating valve (22) for the hot heat storage medium tank; a feedwater inlet of the heat storage medium and feedwater heat exchanger (21) is connected with a feedwater inlet of the first-stage high pressure heater (9) through the inlet regulating valve (12) for the first-stage high pressure heater, is connected with a feedwater inlet of the second-stage high pressure heater (10) through the inlet regulating valve (13) for the second-stage high pressure heater, is connected with a feedwater inlet of the third-stage high pressure heater (11) through the inlet regulating valve (14) for the third-stage high pressure heater, and is connected with a feedwater outlet of the third-stage high pressure heater through the outlet regulating valve (15) for the third-stage high pressure heater; a feedwater outlet of the heat storage medium and feedwater heat exchanger (21) is connected with the feedwater outlet of the third-stage high pressure heater (11); the cold heat storage medium tank (18) is connected with the hot heat storage medium tank (20) through the connection valve (19) for connecting the cold heat storage medium tank with the hot heat storage medium tank; a superheated steam outlet of the boiler (1) is connected with an inlet of the steam turbine high pressure cylinder (2); a feedwater inlet of the boiler (1) is connected with the feedwater outlet of the third-stage high pressure heater (11); a steam outlet of the steam turbine high pressure cylinder (2) is connected with a steam inlet of the steam turbine medium and low pressure cylinder (3) through the boiler (1), and is connected with a superheated steam inlet of the second-stage high pressure heater (10) through a pipeline; a first-stage steam extraction outlet of the steam turbine high pressure cylinder (2) is connected with a steam inlet of the third-stage high pressure heater (11) through a pipeline; a first-stage steam extraction outlet of the steam turbine medium and low pressure cylinder (3) is connected with a steam inlet of the first-stage high pressure heater (9) through a pipeline, and a second-stage steam extraction outlet of the steam turbine medium and low pressure cylinder (3) is connected with a steam inlet of the deaerator (7) through a pipeline, and a third-stage steam extraction outlet of the steam turbine medium and low pressure cylinder (3) is connected with a steam inlet of the low pressure heater (6) through a pipeline; a steam outlet of the steam turbine medium and low pressure cylinder (3) is connected with a steam inlet of the condenser (4); a water outlet of the condenser (4) is connected with a water inlet of the low pressure heater (6) through the condensate pump (5); a water outlet of the low pressure heater (6) is connected with a water inlet of the deaerator (7); a water outlet of the deaerator (7) is connected with the feedwater inlet of the first-stage high pressure heater (9) and the feedwater inlet of the heat storage medium and feedwater heat exchanger (21) through the feedwater pump (8); a feedwater outlet of the first-stage high pressure heater (9) is connected with the feedwater inlet of the second-stage high pressure heater (10) through a pipeline; a feedwater outlet of the second-stage high pressure heater (10) is connected with the feedwater inlet of the third-stage high pressure heater (11) through a pipeline.

2. The flexible coal-fired power generation system according to claim 1, wherein a heat storage medium adopted by the high-temperature heat storage system is heat transfer oil.

3. The flexible coal-fired power generation system according to claim 1, wherein a flue gas temperature of the boiler (1) where the heat storage medium heater (16) is located is greater than 400° C.

4. An operation method of the flexible coal-fired power generation system according to claim 1, the operation method comprising steps of: when a load of a coal-fired power generating unit needs to be reduced, closing the inlet regulating valve (12) for the first-stage high pressure heater, the inlet regulating valve (13) for the second-stage high pressure heater, the inlet regulating valve (14) for the third-stage high pressure heater and the outlet regulating valve (15) for the third-stage high pressure heater, opening the connection valve (19) for connecting the cold heat storage medium tank with the hot heat storage medium tank, staring the heat storage medium pump (17), adjusting a flow of cold heat storage medium that enters the heat storage medium heater (16) and exchanges heat with high-temperature flue gas through the heat storage medium pump (17), heat storage medium after heat exchange entering the hot heat storage medium tank (20), and adjusting quantity of heat storage medium in the cold heat storage medium tank and quantity of heat storage medium in the hot heat storage medium tank to a balance through the connection valve (19) for connecting the cold heat storage medium tank with the hot heat storage medium tank, wherein an adjustment goal is to reduce an output of a steam turbine when the boiler (1) is stably burning;

when the load of the coal-fired power generating unit needs to be increased, stopping the heat storage medium pump (17), opening the outlet regulating valve (22) for the hot heat storage medium tank, adjusting a flow of hot heat storage medium that enters the heat storage medium and feedwater heat exchanger (21) through the outlet regulating valve (22), adjusting flow and temperature of feedwater that enters the heat storage medium and feedwater heat exchanger (21) through switching on/off at least one of the inlet regulating valve (12) for the first-stage high pressure heater, the inlet regulating valve (13) for the second-stage high pressure heater, the inlet regulating valve (14) for the third-stage high pressure heater and the outlet regulating valve (15) for the third-stage high pressure heater, wherein adjustment goals are to increase the temperature of feedwater, and to make a flow change rate of main stream that enters the steam turbine high pressure cylinder (2) through the boiler (1) and a flow change rate of reheat stream that enters the steam turbine medium and low pressure cylinder (3) through the boiler (1) meet a requirement of an electric load change rate of the steam turbine, so that the flexible coal-fired power generation system is able to meet a requirement of fast load cycling rate.

* * * * *